US010865594B2

(12) United States Patent
Romero et al.

(10) Patent No.: US 10,865,594 B2
(45) Date of Patent: Dec. 15, 2020

(54) SLIDING DOOR MECHANISM

(71) Applicant: Kohler Mira Limited, Cheltenham (GB)

(72) Inventors: José Luis Beltrán Romero, Cheltenham (GB); Adolfo Placencia Mendia, Gloucester (GB)

(73) Assignee: KOHLER MIRA LIMITED

( * ) Notice: Subject to any disclaimer, the term of this patent is extended or adjusted under 35 U.S.C. 154(b) by 168 days.

(21) Appl. No.: 16/070,370

(22) PCT Filed: Jan. 9, 2017

(86) PCT No.: PCT/GB2017/050035

§ 371 (c)(1),
(2) Date: Jul. 16, 2018

(87) PCT Pub. No.: WO2017/125713

PCT Pub. Date: Jul. 27, 2017

(65) Prior Publication Data

US 2019/0017306 A1 Jan. 17, 2019

(30) Foreign Application Priority Data

Jan. 20, 2016 (GB) ..... 1601083.7
Nov. 17, 2016 (GB) ..... 1619465.6

(51) Int. Cl.
*A47K 3/36* (2006.01)
*E05D 15/06* (2006.01)
*A47K 3/34* (2006.01)

(52) U.S. Cl.
CPC ..... *E05D 15/0647* (2013.01); *A47K 3/34* (2013.01); *A47K 3/362* (2013.01); *E05D 15/0652* (2013.01); *E05Y 2900/114* (2013.01)

(58) Field of Classification Search
CPC ..... E05D 15/0652; E05D 15/0647; E05D 15/0682; A47K 3/362; A47K 3/34
See application file for complete search history.

(56) References Cited

U.S. PATENT DOCUMENTS 3,198,243 A * 8/1965 Ford ..... A47H 5/03 160/347
3,457,677 A * 7/1969 Ziegler ..... E05D 15/0647 49/409

(Continued)

FOREIGN PATENT DOCUMENTS

DE 2809404 9/1979
DE 10231841 1/2003

(Continued)

OTHER PUBLICATIONS

International Search Report and Written Opinion dated Mar. 20, 2017; 14 pages.

*Primary Examiner* — Justin B Rephann
(74) *Attorney, Agent, or Firm* — Foley & Lardner LLP

(57) ABSTRACT

A shower enclosure sliding door mechanism (1) includes a first member provided on a door (3) of a shower enclosure, and a second member provided on a frame (5) of the shower enclosure, the first and second members slidably engaged with each other such that a first bearing surface (33) of the first member slidably engages a second bearing surface (27) of the second member. The first bearing surface is formed from a first low friction material and the second bearing surface is formed from a second low friction material, such that a low friction interface is formed between the first member and the second member.

20 Claims, 9 Drawing Sheets

(56) References Cited

U.S. PATENT DOCUMENTS 3,522,621 A * 8/1970 Ford ..... A47H 13/14 16/87.4 R
3,823,439 A * 7/1974 Selset ..... A47H 1/08 16/94 D
3,854,165 A * 12/1974 Haley ..... E06B 3/4663 16/96 R
4,051,633 A * 10/1977 Voegele, Jr. ..... E05D 15/0647 49/411
4,359,080 A * 11/1982 Brydolf ..... E05D 15/26 160/183
4,773,769 A * 9/1988 Church ..... F16C 29/02 384/40
4,819,297 A * 4/1989 Jacobs ..... E05D 15/0647 16/87 R
4,868,935 A 9/1989 Van Weelden
4,887,394 A * 12/1989 Marlowe ..... A47K 3/34 49/409
5,421,059 A * 6/1995 Leffers, Jr. ..... A47H 1/104 16/87.4 R
5,893,181 A * 4/1999 Moncaster ..... A47K 3/362 160/211
6,131,340 A * 10/2000 Clark ..... B63B 43/24 114/202
6,158,123 A * 12/2000 Bryson ..... B23P 15/00 29/434
6,374,456 B1 * 4/2002 Fort ..... E05D 15/0613 16/87.6 R
6,381,904 B1 * 5/2002 Tedescucci ..... A47K 3/34 16/87.4 R
6,925,681 B2 * 8/2005 Lin ..... B60J 1/2011 16/87 R
2006/0207184 A1 9/2006 Whitaker
2006/0230575 A1 10/2006 Quinn et al.
2006/0277850 A1 12/2006 Gravel
2007/0227074 A1 * 10/2007 Frank ..... E05D 15/063 49/409
2011/0072577 A1 * 3/2011 Luedke ..... A47K 3/34 4/607
2012/0005964 A1 * 1/2012 Isaacs ..... E05D 15/066 49/452
2015/0075077 A1 3/2015 Aragon et al.
2015/0164284 A1 * 6/2015 Sprague ..... E05D 15/0686 49/411

FOREIGN PATENT DOCUMENTS

EP 0288643 12/1987
WO WO2011/159300 12/2011

* cited by examiner

SLIDING DOOR MECHANISM

CROSS-REFERENCE TO RELATED PATENT APPLICATIONS

This application is a U.S. National Stage application of International Application No. PCT/GB2017/050035, filed Jan. 9, 2017, which claims priority to and the benefit of both United Kingdom Patent Application 1601083.7, filed Jan. 20, 2016, and United Kingdom Patent Application 1619465.6, filed Nov. 17, 2016. The entire disclosures of each of the aforementioned applications are incorporated herein by reference in their entireties.

BACKGROUND

This invention relates to a sliding door mechanism. More especially, but not exclusively, the invention relates to a sliding door mechanism for a shower enclosure.

It is known to provide shower enclosures with a sliding door to open and close an opening in the enclosure, for a user to enter and leave a shower area. A common method of mounting the door uses roller bearings fitted in a channel. These are noisy and expensive and, over-time, may require cleaning to maintain optimum performance.

Also the size of the roller bearing limits the minimum depth of the profile that can be used to mount the roller bearings on the frame and thus restricts the design of the enclosure.

A preferred object of the present invention is to provide an improved sliding door mechanism for a shower door.

SUMMARY

According to one aspect of the invention, there is provided a sliding door mechanism for a door of a shower enclosure, the sliding door mechanism including: a first member provided on a door of a shower enclosure; and a second member provided on a frame of the shower enclosure, the first and second members slidably engaged with each other such that a first bearing surface of the first member slidably engages a second bearing surface of the second member, wherein the first bearing surface is formed from a first low friction material and the second bearing surface is formed from a second low friction material, such that a low friction interface is formed between the first member and the second member.

The first bearing surface and second bearing surface may contact each other at one or more bearing points.

One or more gaps between the first bearing surface and second bearing surface may be formed adjacent the one or more bearing points.

The first bearing surface may contact the second bearing surface at least at the bottom of the first bearing surface.

The second bearing surface may comprise a pair of surfaces sloped towards a base point or region.

The second bearing surface may be arranged to locate the first bearing surface with respect to the second bearing surface.

The sloped surfaces meet may at an apex, such that the second bearing surface is substantially V-shaped. Alternatively, the second bearing surface may include a base section that is flat or rectangular, wherein the sloped surfaces extend from opposite sides of the base section.

The first bearing surface may be provided on a bearing member mounted on a carrier arranged to be secured to the door. The carrier may include means for mounting the bearing member on a first side of the door. The carrier may further include means for mounting the bearing member on a second side of the door, opposite the first side.

The carrier may be configured for adjusting the position of the door relative to the frame. For example, the carrier may allow the door to be raised or lowered relative to the frame.

The bearing member may include the first low friction material on at least the portion of the bearing member that forms the low friction interface with the channel.

The first bearing surface and second bearing surface may be substantially symmetrical, about a first axis.

The second member may be an elongate channel constructed and arranged to receive at least a portion of the first bearing surface, the first and second portions of the second bearing surface extending along the length of the channel, and the first and second portions of the first bearing surface extending along a portion of the length of the channel. The carrier may be slidable along the channel to open and close an opening in the frame.

The second low friction material may be provided on at least the portion of the channel that forms the low friction interface.

The channel may be formed of the same material as the frame.

The first and/or second low friction material may be provided as a tape secured to the first and/or second bearing surface.

The first bearing surface may include a pair of surfaces sloped towards a base point or region, which preferably meet at an apex, such that the first bearing surface is substantially V-shaped. Alternatively, the first bearing surface includes a flat base, the sloped sides extending from either end of the flat base.

The angle between the sloped surfaces of the first bearing surface may be less than the angle between the sloped surfaces of the second bearing surface. Alternatively, at least a portion of the first bearing surface may be parallel to the second bearing surface.

The low friction interface may have a coefficient of surface friction of less than 0.50μ, preferably less than 0.30μ, more preferably less than 0.20μ, and most preferably less than 0.10μ.

The first low friction material may be a polymer.

The second low friction material may be a metal or alloy such as anodized aluminium or polished stainless steel. Anodized aluminium may have an anodized surface of thickness between 1 and 5 microns. The anodized aluminium surface may be polished prior to anodization.

The first low friction surface and/or the second low friction surface may include a low friction coating or one or more pads of low friction material.

The sliding door mechanism may include a plurality of first members slidably engaged with the second member.

The first member and second member may be provided at the top of the door, and/or the bottom of the door.

According to another aspect of the invention, there is provided a shower enclosure, including a frame defining an opening, a door, and a sliding door mechanism according to the first aspect, the sliding door for mechanism mounting the door to the frame for sliding movement relative to the frame to open and close the opening.

According to a further another aspect of the invention, there is provided a kit of parts for assembly of the sliding door mechanism of the first aspect.

According to yet a further aspect of the invention, there is provided a kit of parts for assembly of the shower enclosure of the second aspect.

BRIEF DESCRIPTION OF THE DRAWINGS

The invention will now be described, by way of example only, with reference to the accompanying drawings, in which.

DETAILED DESCRIPTION

Figure 1A:
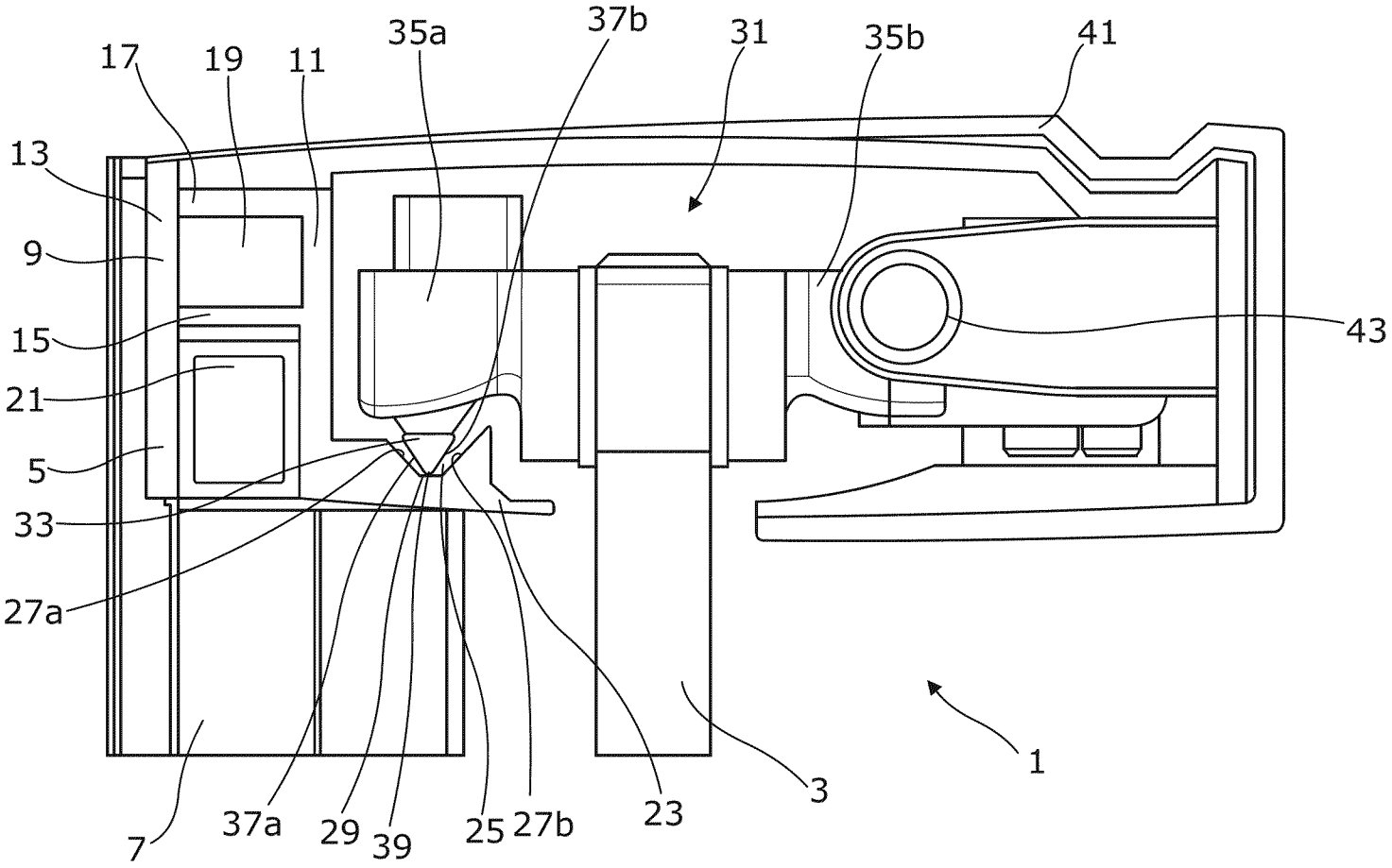
FIGS. 1A and 1B are end views of a sliding door mechanism according to a first embodiment of the invention.
Figure 1B:
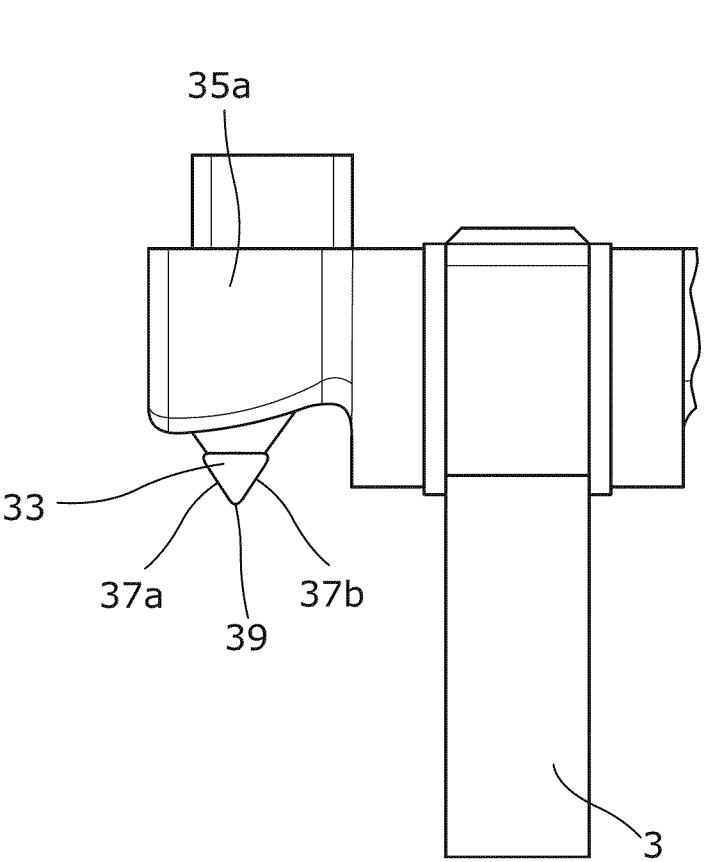
Figure 1B:
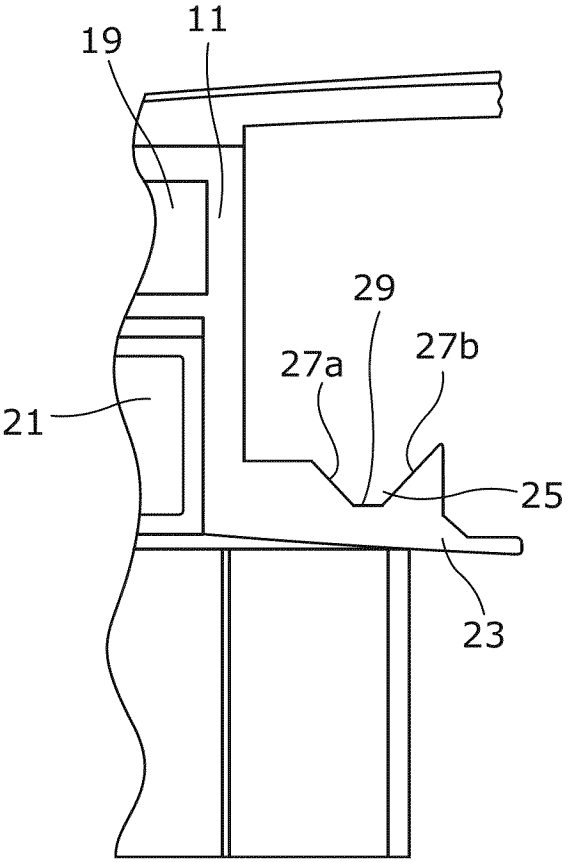

FIGS. 1A-1B show a first embodiment of a sliding door mechanism 1. The sliding door mechanism 1 may be employed for mounting a moveable panel 3 to a frame 5 of a fixed structure such that the moving panel 3 can be slid along the frame 5.

For example, the moveable panel 3 may be a door of a shower enclosure, and the frame 5 may form the body of the shower enclosure. The shower enclosure may include one or more fixed panels 7 mounted on the frame 5, extending parallel to the door 3. The moveable panel 3 may comprise a transparent or translucent panel, for example a glass or plastic panel, and is typically, but not exclusively, rectangular. The or each fixed panel 7 may comprise a transparent or translucent panel, for example a glass or plastic panel, and is typically, but not exclusively, rectangular.

In use, the moveable panel 3 is slid along the frame 5 to open and close an opening in the enclosure. Other panels may be provided to form a complete enclosure. FIG. 1A shows only a portion of the moveable panel 3, fixed panel 7 and frame 5. The configuration of the enclosure may vary according to the installation.

The portion of the frame 5 shown in FIG. 1A includes an elongate header rail 9 extending in a horizontal direction at the top of the frame 5. The header rail 9 has opposed side walls 11, 13 connected by transverse walls 15, 17 that define a hollow box section 19 and a channel section 21. The channel section 21 opens to the underside of the header rail 9 and the upper end of the fixed panel 7 is received in the channel section 21 with any suitable seal (not shown) between the panel 7 and the header rail 9.

A projection 23 extends horizontally away from the fixed panel 7, towards the moveable panel 3, on the outer face of the side wall 11 adjacent the moveable panel 3. The projection 23 extends along the length of the header rail 9 and has a channel 25 in the upper surface. The channel 25 forms a bearing surface 27 having a first portion 27*a* and a second portion 27*b*. In cross section, the first and second portions 27*a*, 27*b* extend at an angle to one another, and meet at a flat base portion 29. The bearing surface 27 is symmetrical about a vertical axis running through the centre of the base section 29, such that the channel is of truncated V-shaped cross section.

The header rail 9 is preferably formed of metal or alloy and may be cut to length from an extrusion. In one example the header rail 9 is made of aluminium. In another example the header rail 9 is made of stainless steel. The header rail 9 is preferably configured to form the low friction bearing surface 27. For example the header rail 9 or at least the bearing surface 27 may comprise anodised aluminium or polished stainless steel. Anodization forms an oxide layer that may be between 1 micron and 3 microns thick. In one example, the anodized layer is 2 microns thick. Prior to anodization, the aluminium may be highly polished. Anodized aluminium and polished stainless steel are considered to be low friction materials. Other suitable low friction materials that might be used in practising the invention will be apparent to those skilled in the art.

The moveable panel 3 is provided with a pair of carriers 31 (one only shown) attached to the top of the panel 3, preferably adjacent to the corners. One or more additional carriers 31 may be attached to the top of the panel 3 between the carriers 31.

Each carrier 31 is similar and has arms 35*a,b* provided on opposing sides of the moveable panel 3, and at least one bearing member 33 mounted in the arms 35*a*, for engagement with the channel 25, in order to mount the moveable panel 3 on the frame 5.

The carrier 31 will be discussed in more detail below, in relation to the third embodiment.

The or each bearing member 33 forms a bearing surface 37 on a lower section, having a first portion 37*a* and a second portion 37*b*. In cross section, the first and second portions 37*a*, 37*b* extend at an angle to one another, and meet at an apex 39. The bearing surface 37 is symmetric about a vertical axis running through the apex 39, such that the bearing surface 37 has a V-shaped cross section on a lower surface.

The angle between the first and second portions 37*a,b* of the bearing surface 37 of the bearing member 33 is less than the angle between the first and second portions 27*a,b* forming the bearing surface 27 in the channel 25. Therefore, in cross-section, the first and second portions 37*a, b* of the bearing surface 37 on the bearing member 33, extend at an angle to the first and second portions 17*a, b* on the bearing surface 17 on the channel 25, and the bearing member 33 forms a single contact point with the channel 23, at apex 39 of the bearing member 33 and the base 29 of the channel 23. The bearing surface of the channel 25 is spaced form the bearing surface of the bearing member 33 either side of the contact point, forming gaps.

A contact point may extend along the length of the channel, however, when viewing in cross section, the contact point forms a single location at which the two surfaces contact.

The or each bearing member 33 or at least the bearing surface 37 are made of a low friction material, for example a low friction polymer material. The or each bearing member 22 may be formed as a moulding.

The material forming the two bearing surfaces 27, 37 may be chosen to provide a coefficient of surface friction of 0.50μ or less, preferably 0.30μ or less, more preferably 0.20μ or less and most preferably 0.10μ or less. In some examples a silicone based lubricant may be used to help lubricate the interface.

As discussed above, the moveable panel 3 has at least two carriers 31, with bearing members 33 on the same side of the panel 3. The movable panel 3 is suspended from the header rail 9 by positioning the bearing members 33 facing the header rail 9 in the channel 25, extending along the length of the header rail 9. The inclination of the bearing surface 27 of the channel 15 and the bearing surface 37 of the bearing members 33 acts to locate the bearing members 33 in the channel 25, at the lowest point of the channel 25, so that the carrier 31 is spaced from the side wall 11 of the frame 5 and the moveable panel 3 is spaced from the projection 23, and is located in the channel 25. The locating action may be by the force of gravity acting on the bearing member 33, in the channel 25.

The low friction interface formed between the bearing surface 27 of the channel 25 and the bearing surface 37 of the bearing members 33 allows the moveable panel 3 to be displaced relative to the frame 5 to open and close the opening in the enclosure without undue force, and with a smooth motion providing a pleasant tactile feedback to the user.

Furthermore, since there are no bearings, the mechanism 1 is simpler and less expensive to manufacture and install, and much quieter than mechanisms using bearings. Roller bearings are relatively complex and expensive to make and assemble. Furthermore, roller bearings typically start to degrade, and become noisy and start to jolt, so that the motion of the door is no longer smooth, e.g. after approximately 20,000 usage cycles (opening and closing the door), and often fail after e.g. 30,000 usage cycles. The roller bearings require lubricant. However, the lubricant can often collect in the bottom of the channel, where it is not useful. Dirt can also collect in the bottom of the channel. The mechanism of this invention is also longer lasting, since there is no wear of moving parts. The use of the low friction interface allows at least 40,000 cycles with little wear.

Since the bearing members contact at a single point, rather than over an extended area, the contact between the bearing surfaces is minimised, and friction further reduced.

The fact that the bearing member 33 fits into the base of the channel 25 prevents accumulation of dirt at that location, and so the mechanism can be considered self-cleaning. Furthermore, the fact that the bearing member 33 fits into the base of the channel 25 also prevents build-up of lubricant, and helps to distribute the lubricant throughout the mechanism 1. Therefore, the mechanism 1 can also be considered self-lubricating. In some examples, the self-lubricating effect can be seen to improve the performance of the door (in relation to noise and tactile feedback) after some usage (such as 30,000 use cycles).

The door mechanism 1 can also be implemented with low profile frames, since it requires less space than a mechanism using bearings.

By providing arms 35*a,b* on either side of the moveable panel 3, each of which can be used to mount bearing members 33, the panel 3 is unhanded and can be mounted with either side of the panel 3 facing the frame 5. In other examples (not shown), the carriers 31 may have bearing members 33 on both sides, so that the door can be fully unhanded without having to install the bearing member 33.

Figure 2:
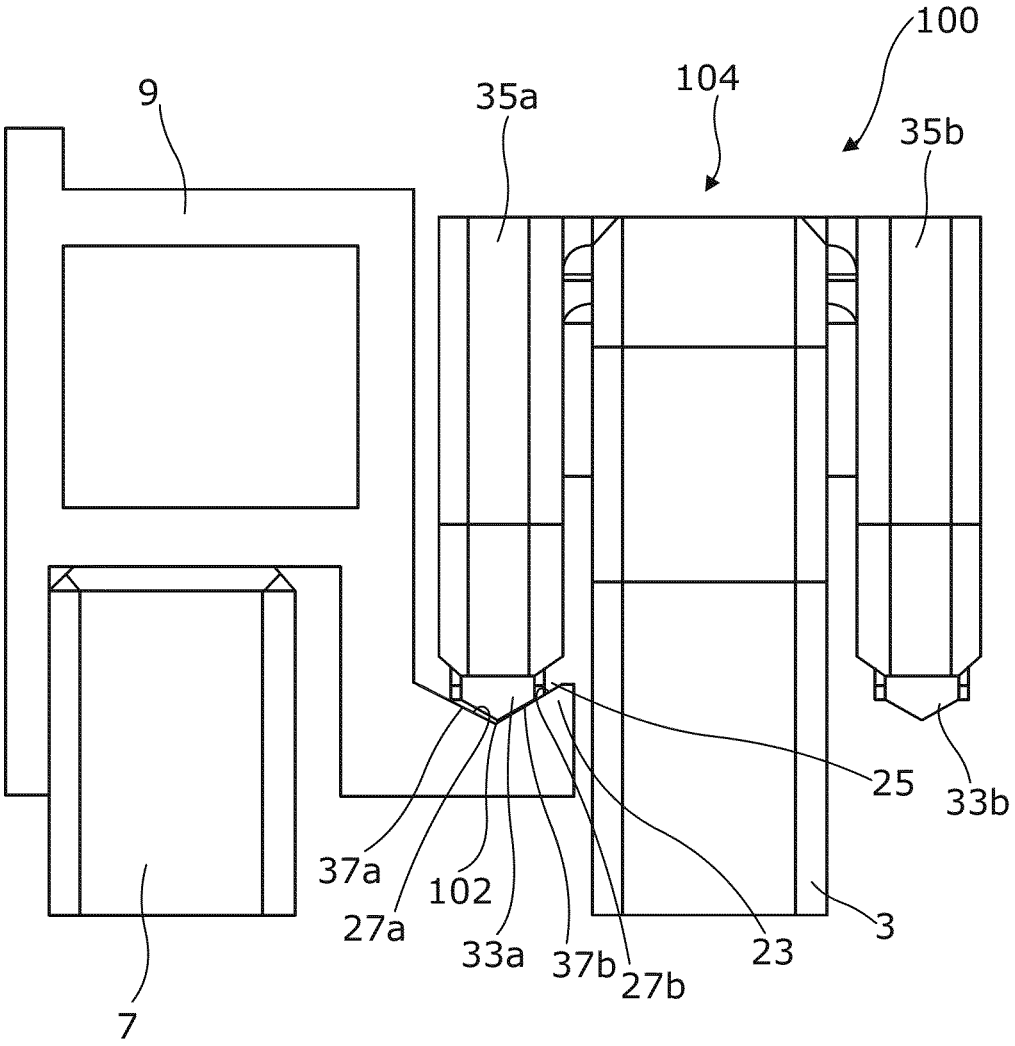
FIG. 2 is an end view of a sliding door mechanism according to a second embodiment of the invention.
Figure 3A:
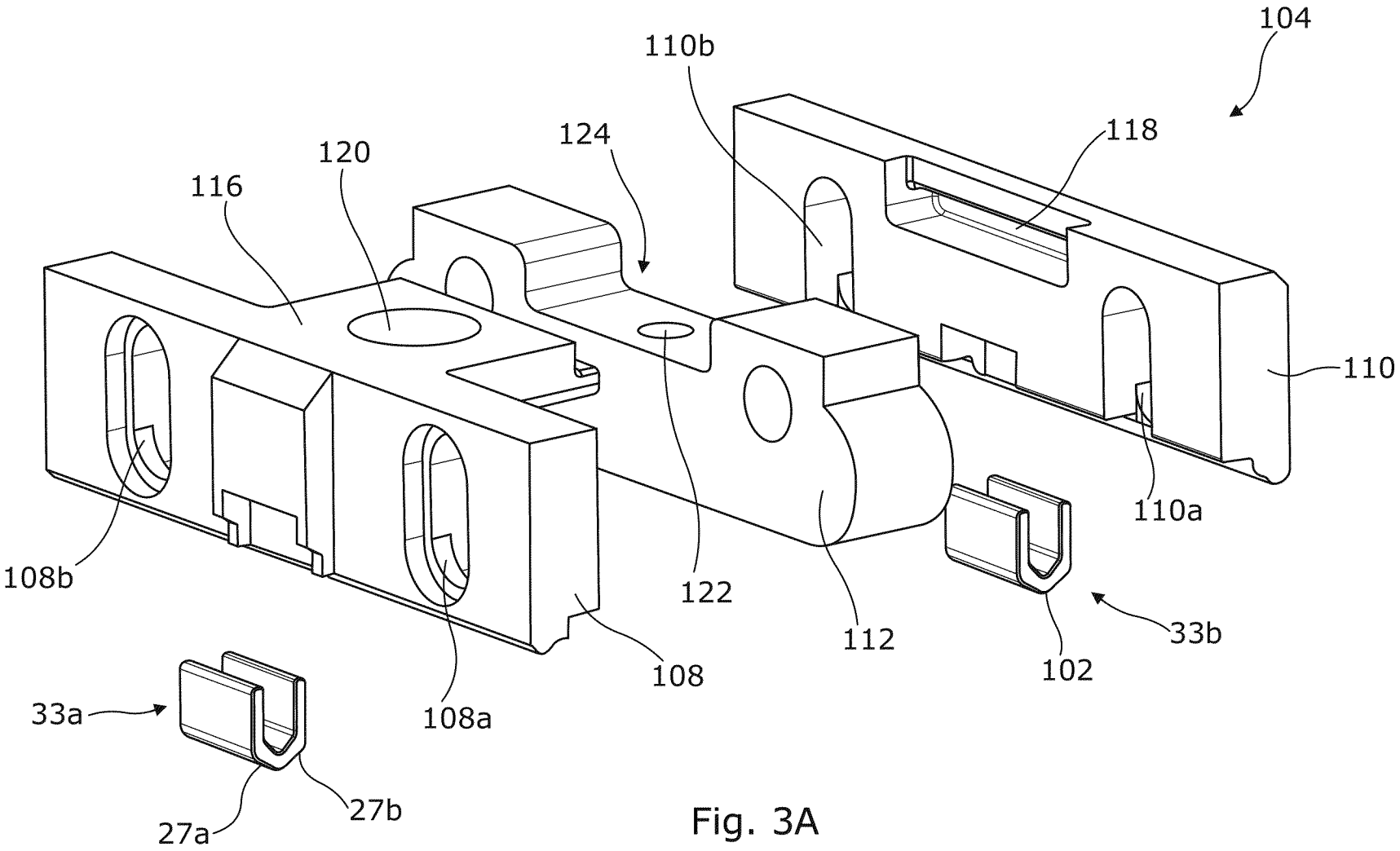
FIG. 3A is an exploded perspective view of a carrier for use in the mechanism of FIG. 2.
Figure 3B:
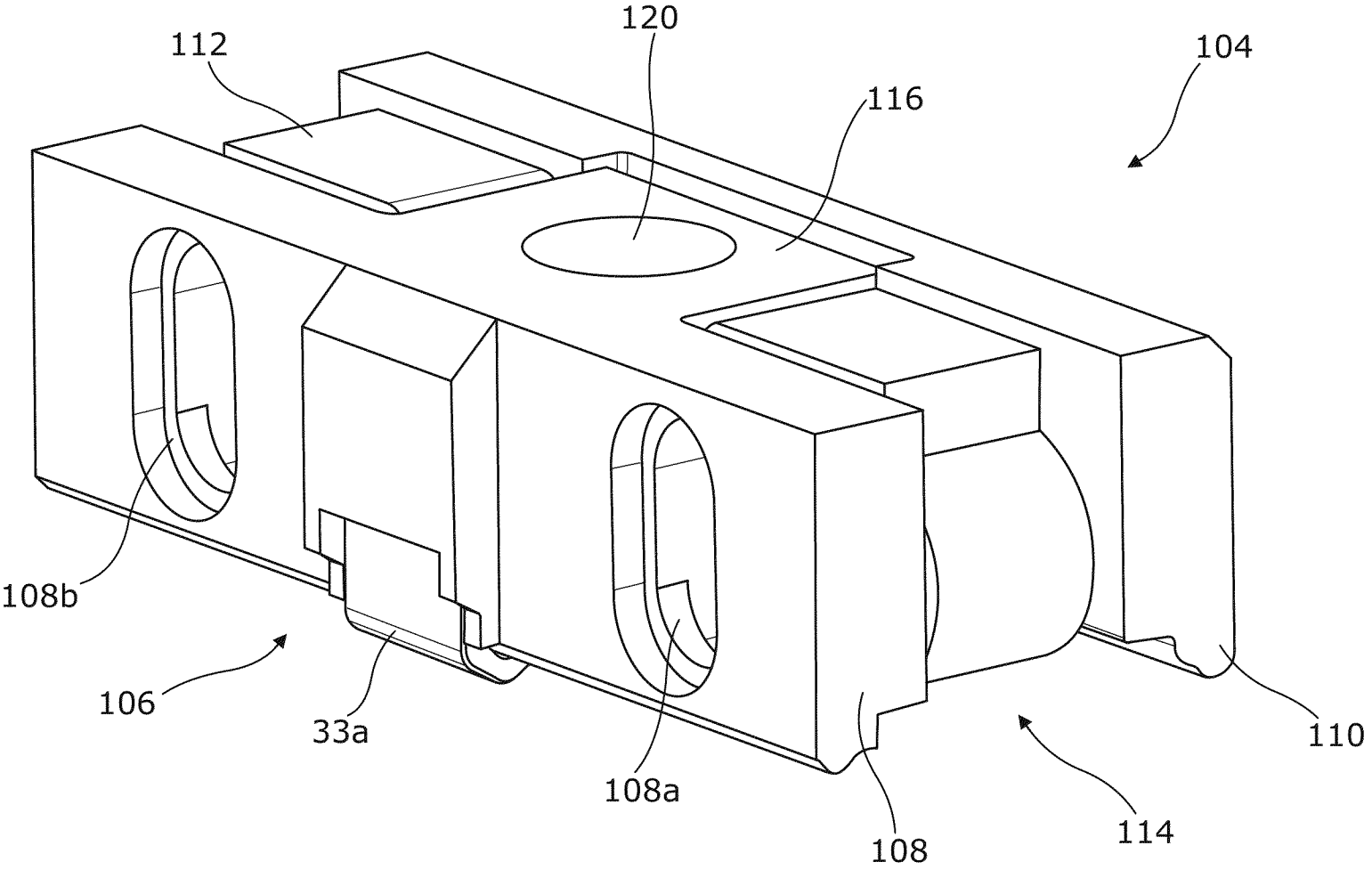
FIG. 3B is a perspective view of the carrier shown in FIG. 3A.
Figure 4:
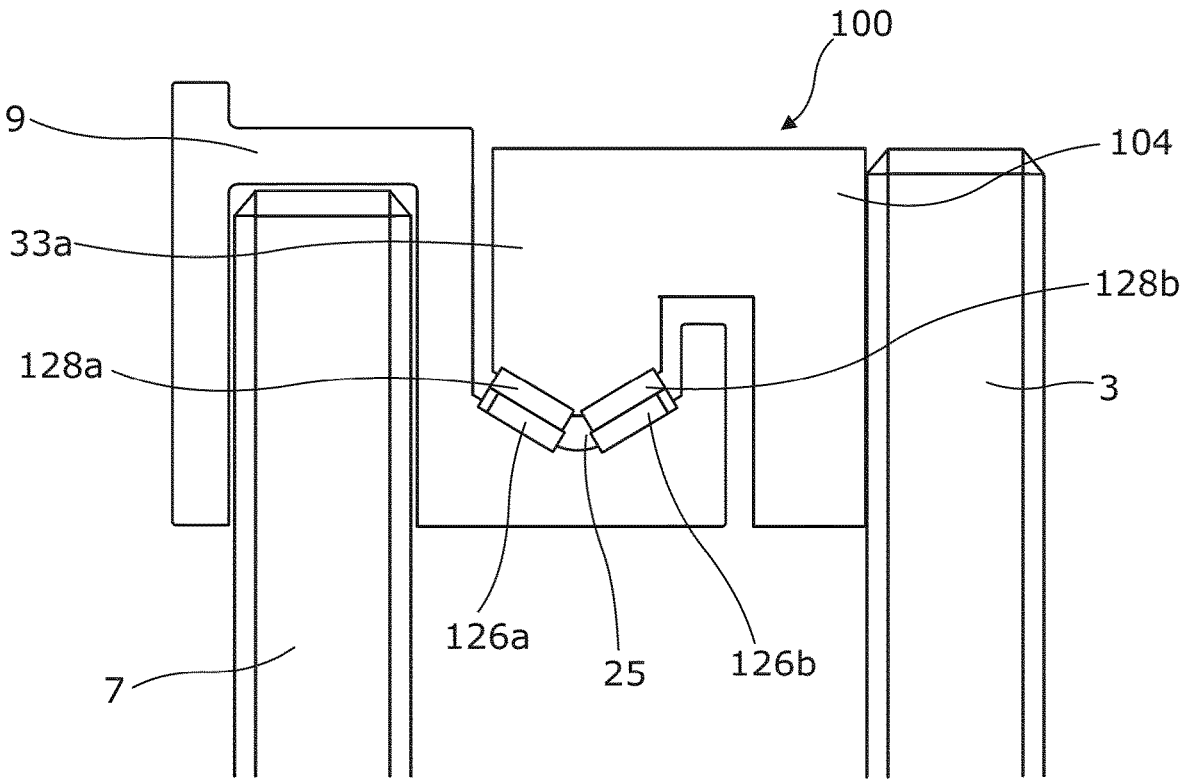
FIG. 4 is a schematic end view of an alternative sliding door mechanism according to the second embodiment of the invention.

FIGS. 2 to 4 show a second embodiment of a sliding door mechanism 100. Unless otherwise stated, the second embodiment is the same as the first.

As shown in FIG. 2, the construction of the fixed panel 7 and header rail 9 are similar to the first embodiment. However, in the second embodiment, the channel 25 forms a bearing surface 27 having a first portion 27*a* and a second portion 27*b* that extend at an angle to one another, and meet at an apex 102 at the base of the bearing surface 27. The bearing surface 27 is symmetric about a vertical axis running through the apex 102, such that the bearing surface 37 of the bearing member 33 has a V-shaped cross section on a lower surface.

As in the embodiment shown in FIGS. 1A-1B, the carrier 104 is mounted at the top of the door, and includes a pair of arms 35*a,b* on either side of the moveable panel 3, with a bearing member 33*a* mounted on the bottom of the arm 35*a*, and sitting in the channel 25. However, the carrier 104 shown in FIG. 2 is of different construction to the carrier 31 shown in FIGS. 1A-1B.

As also shown in the first embodiment, the bearing member 33*a* is substantially V-shaped in cross section. However, in the second embodiment, the angle between the first and second portions 37*a,b* of the bearing surface 37 of the bearing member 33 matches angle between the first and second portions 27*a,b* of the bearing surface 27 of the channel 25, such that the first and second portions 37*a,b* of the bearing surface 37 of the bearing member 33 and the first and second portions 27*a,b* of the bearing surface 27 of the channel 25 are parallel.

Furthermore, in the second embodiment, a bearing member 33 is provided on each arm 35*a, b*.

The low friction interface formed between the bearing surface 27 of the channel 25 and the bearing surface 37 of the bearing members 33 is a single, continuous contact region, which allows the moveable panel 3 to be displaced relative to the frame 5 to open and close the opening in the enclosure without undue force, and with a smooth motion providing a pleasant tactile feedback to the user.

Furthermore, since there are no bearings, the mechanism 100 is simpler and less expensive to manufacture and install, and much quieter than mechanisms using bearings. The mechanism is also longer lasting, since there is little wear of moving parts.

The fact that the bearing member 33 fits into the base of the channel 25 prevents accumulation of dirt at that location, and so the mechanism can be considered self-cleaning. Furthermore, the fact that the bearing member 33 fits into the base of the channel 25 also prevents build-up of lubricant, and helps to distribute the lubricant throughout the mechanism. Therefore, the mechanism can also be considered self-lubricating. In some examples, the self-lubricating effect can be seen to improve the performance of the door (in relation to noise and tactile feedback) after some usage. the improvement in performance may, at least in part, be due to the lubricant that is used becoming embedded or rubbed into the bearing member around the contact point(s) over time/with use.

The door mechanism 100 can also be implemented with low profile frames, since it requires less space than a mechanism using bearings.

By bearing members 33*a, b* being provided on either side of the moveable panel 3, the moveable panel 3 is unhanded and can be mounted with either side of the panel 3 facing the frame 5. In other examples (not shown), only a single bearing member 33 may be provided. However, it will be appreciated that the moveable panel 3 is still unhanded, since the bearing member 33 can be mounted in either side.

Referring now to FIGS. 3A and 3B, an embodiment of a carrier 104 is shown in more detail. The carrier 104 has a body 106, which is formed of two side portions 108, 110 and a central portion 112, between the side portions 108, 110. The side portions 108,110 extend in a direction parallel to the sides of the moveable panel 3. The top of the moveable panel 3 is received in a space 114 between the side portions 108, 110 of the carrier 104 and the carrier 104 is attached to the panel 3 by fixing means (not shown) secured to the panel 3 in any suitable manner.

The carrier 104 is preferably adjustable for raising or lowering the moveable panel 3 during and/or after installation. In one example, the central portion 112 of the carrier 104 is attached to the moveable panel 3 and the side portions 108, 110 are configured so that the position of the central portion 112 can be adjusted relative to the side portions 108, 110 for raising or lowering the moveable panel 3. In one arrangement, the side portions 108, 110 are provided with one or more elongate openings 108*a*, 108*b*, 110*a*, 110*b* that extend in a vertical direction and the centre portion 112 is provided with one or more through holes 112*a*, 112*b* that align with the elongate openings 108*a*, 108*b*, 110*a*, 110*b* of the side portions 108, 110 for passage of coupling members (not shown) extending between the side portions 108, 110. A first side portion 108 has a bridge portion 116 that extends over the central portion 112 and the other side portion 110 has a recessed portion 118 that receives the outer end of the bridge portion 116. The central portion 112 has a recessed guide portion 124 in the upper surface for passage of the bridge portion 116 and the bridge portion 116 has an opening 120 for passage of an adjustment member (not shown) engageable with an opening 122 in the base of the guide portion 124 by means of which the position of the central portion 112 can adjusted relative to the side portions 108, 110 for raising and lowering the moveable panel 3. This allows for adjustment of the height of the moveable panel 3 during and/or after installation.

At least one and optionally both side portions 108, 110 of the carrier 21 is provided with one or more bearing members 33*a, b* for engagement with the channel 25 on the header rail 9 when mounting the moveable panel 3 on the frame 5 as described in connection with FIG. 2.

In one example, the or each bearing member 33 is of channel section with a V-shaped base wall that provides the bearing surface 27 on the lower surface that meet at a vertex 102. The or each bearing member 33 or at least the bearing surface 27 are made of a low friction material, for example a low friction polymer material. The or each bearing member 33 may be formed as a moulding.

The carrier 104 may be formed of any suitable material, for example metal or alloy or plastics. The bearing members 33*a, b* may be attached to the carrier 104 in any suitable way. For example, mechanical fixings, and/or adhesive may be used. Alternatively, the carrier 104 and bearing members 33*a, b* may be formed of a single unitary piece.

FIG. 4 shows an alternative version of the second embodiment. In the Figure, the carrier 104 and header rail 9 are shown schematically, for clarity.

In this example the bearing surface 27 in the channel is formed by strips 126 of material (such as a tape) fixed to the surface of the channel 25. Similarly, the bearing surface 37 on the bearing member 33 is formed by formed by strips 128 of material (such as a tape) fixed to the surface of the bearing member 33*a*. In the example shown, the tape is not provided to the apex 104 of the channel or the apex 39 of the bearing member 33, so the bearing surfaces 27, 37 are truncated V-shaped in cross section. In other examples, the tape may be provided to one or both of the apexes 104, 39.

The strips 126, 128 may be attached to the channel 25 and bearing member 33 in any suitable manner. For example, mechanical fixings, and/or adhesive may be used.

In another example, a coating (not shown) of low friction material may be fixed to or formed on the bearing surface of the carrier 21 that provides the low friction interface with the bearing surface of the channel 14 on the frame 5. The coating may be, for example between 2 and 5 microns thick. If the coating is fixed to the carrier, the fixing may be by adhesive or mechanical fixings. If the coating is formed on the carrier, the coating may be sprayed on, or deposited in place, for example by physical vapour deposition (PVD).

Figure 5:
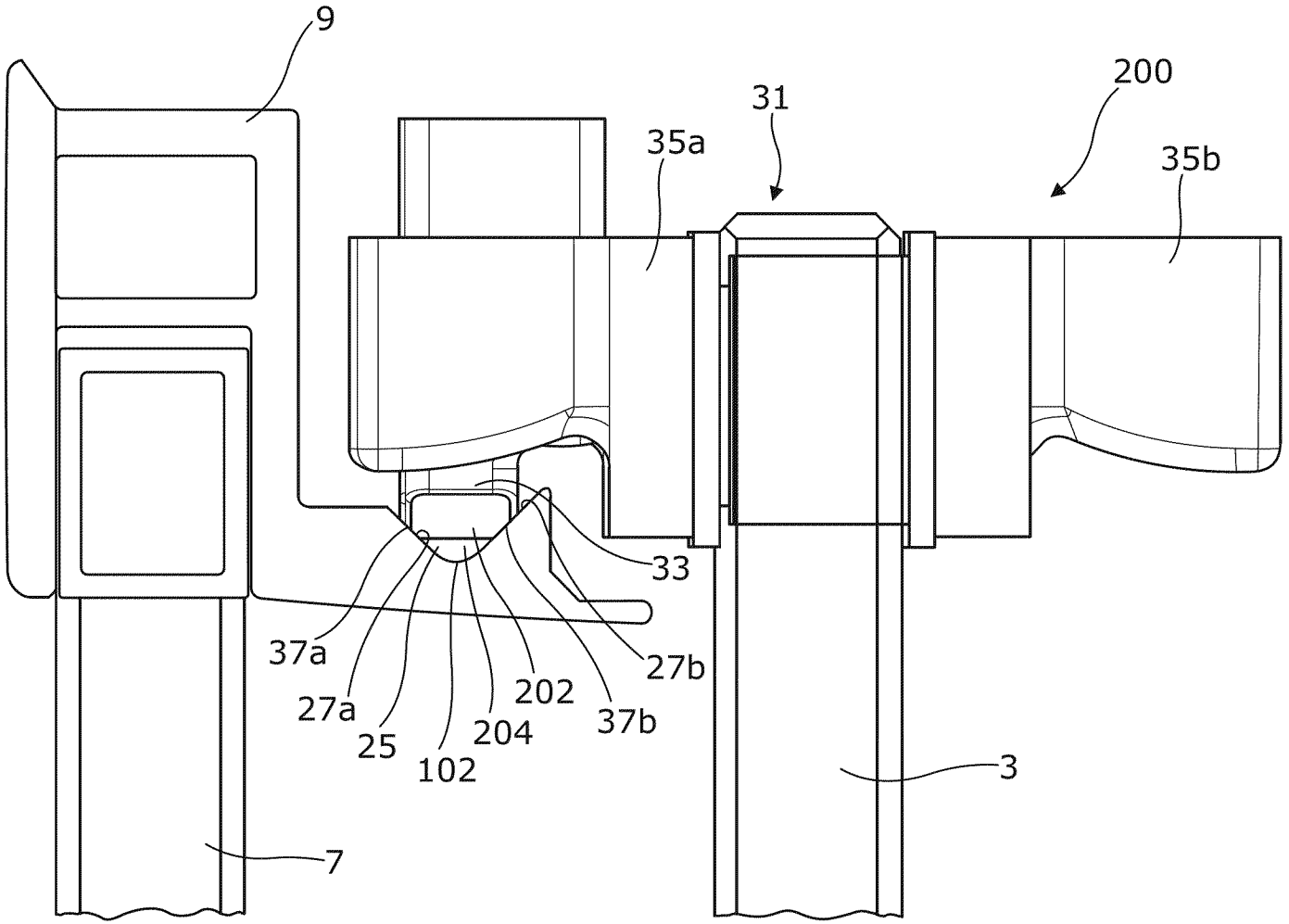
FIG. 5 is an end view of a sliding door mechanism according to a third embodiment of the invention.
Figure 6A:
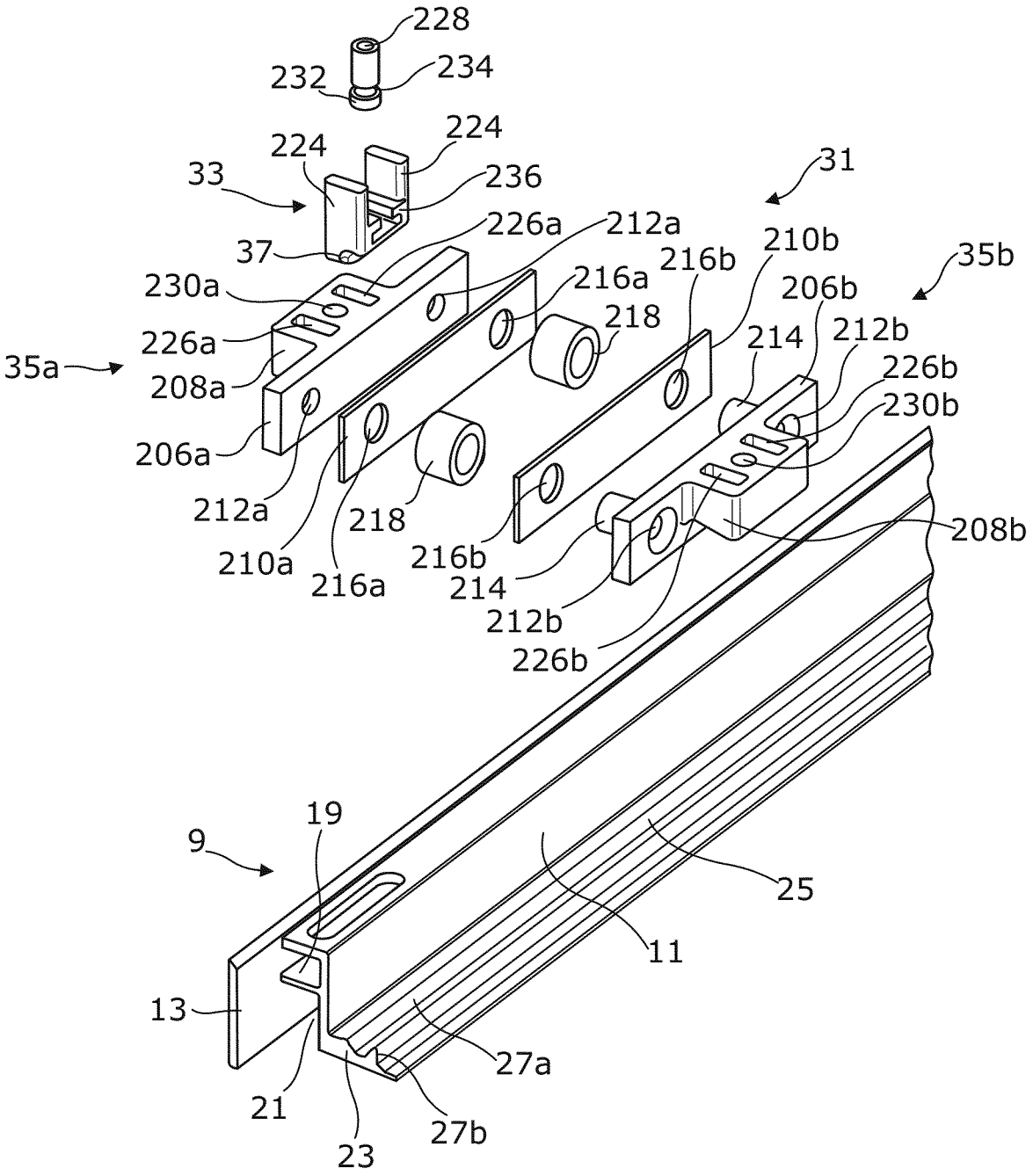
FIG. 6A is an exploded perspective view of the components of the sliding door mechanism of FIG. 5.
Figure 6B:
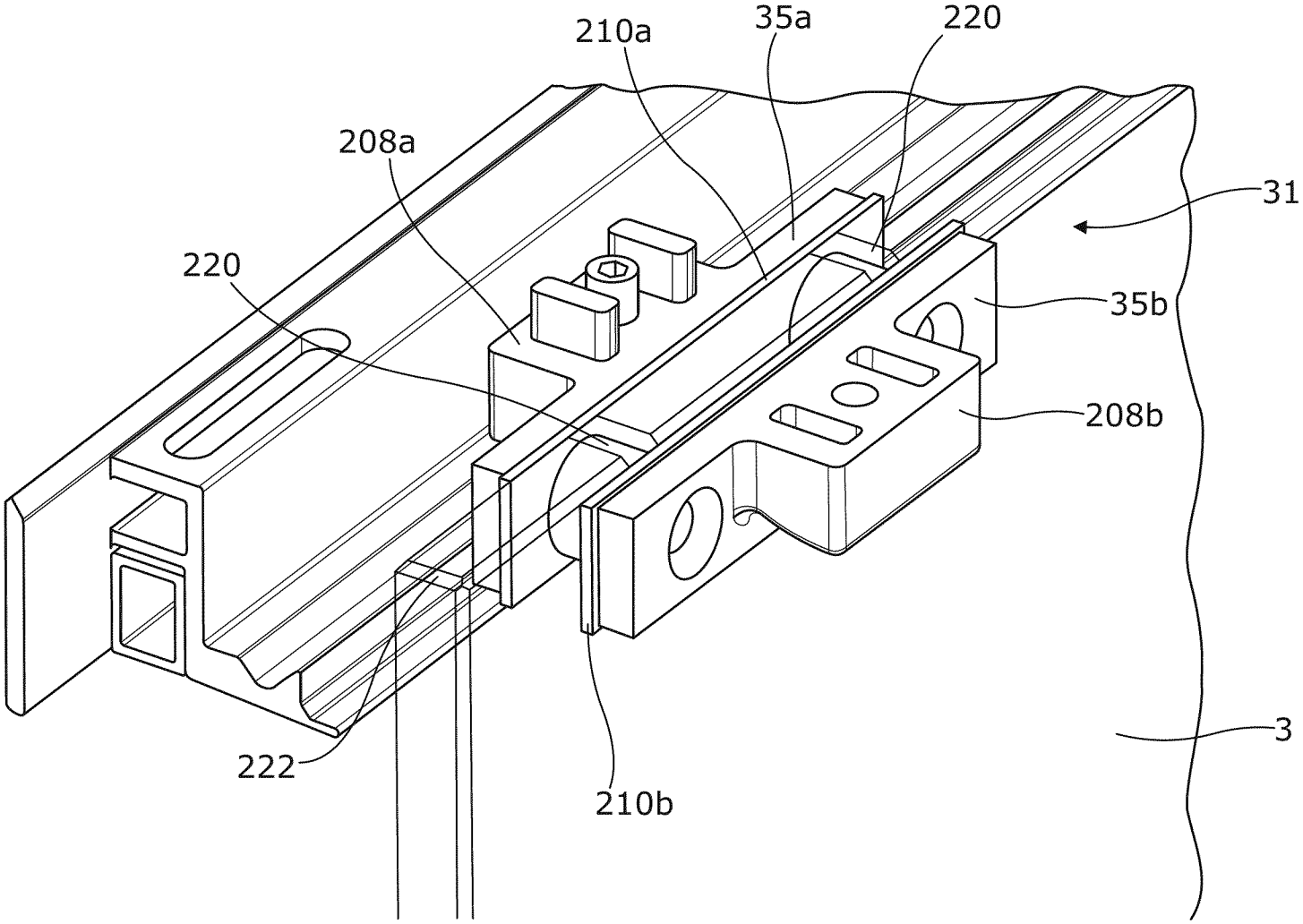
FIG. 6B is a perspective view of the sliding door mechanism of FIG. 5.

FIGS. 5 to 6B show a third embodiment of a sliding door mechanism 200. Unless otherwise stated, the third embodiment is the same as the first.

Referring to FIG. 5, the header rail 9 is formed in the same manner as the first and second embodiments. The channel 25, is formed with an apex 102, such that is it substantially V-shaped, as in the second embodiment.

In cross section, the first and second portions 37*a*, 37*b* of the bearing surface 37 on the bearing member 33 extend at an angle to one another, at the same angle as the portions of the bearing surface 27 on the channel 25, as in the second embodiment.

However, unlike the first and second embodiments, the bearing surfaces do not meet at an apex 39. Instead, the bearing surface has a base 202 formed of a flat section, such that, in cross-section, it forms a truncated V, with a space 204, defined below the bearing member 33. The bearing surface 37 is substantially symmetrical about a vertical axis bisecting the base 202.

The low friction interface formed between the bearing surface 27 of the channel 25 and the bearing surface 37 of the bearing members 33 form two extended contact regions, at the first and second portions 37*a, b* of the bearing member. This allows the moveable panel 3 to be displaced relative to the frame 5 to open and close the opening in the enclosure without undue force, and with smooth motion providing a pleasant tactile feedback to the user.

The space 204 at the base of the channel reduces the overall contact region between the two bearing surfaces 27, 37, further reducing the overall friction.

In some embodiments, the length of the contact regions where the bearing surfaces 27, 37 meet is reduced, until the bearing surfaces 27, 37 meet at two separate contact points. In one example, this can be achieved by making the bearing member 33 have a rectangular shaped lower surface, so that the corners of the rectangular surface form the contact points. This has the effect of further reducing contact area and hence friction. As in the first embodiments, gaps will be formed between the bearing surfaces 27, 37, either side of the bearing member 33, as well as below.

Furthermore, since there are no bearings, the mechanism 200 is simpler and less expensive to manufacture and install, and much quieter than mechanisms using bearings. The mechanism is also longer lasting, since there is no wear of moving parts.

The door mechanism 200 can also be implemented with low profile frames, since it requires less space than a mechanism using bearings.

The third embodiment uses the same carrier 31 as the first embodiment. By providing arms 35*a,b* on either side of the moveable panel 3, each of which can be used to mount bearing members 33, the panel 3 is unhanded and can be mounted with either side of the panel 3 facing the frame 5. In other examples (not shown), the carriers 31 may have bearing members 33 on both sides, so that the door can be fully unhanded without having to install the bearing member 33.

FIG. 6A shows an exploded view of the carrier 31 of the first and third embodiments, and the header rail used in each embodiment. FIG. 6B shows the assembled carrier 31 and header rail 9.

Each arm 35*a,b* is formed of a face plate section 206 and a mounting section 208 projecting from a side of the plate 206 facing away from the glass panel 3. Fixing holes 212 are formed in the face plate 206, either side of the mounting section 208. From one of the two arms 35*b*, guiding projections 214 extend away from the plate 206*b*, in the opposite direction to the mounting section 208*b*. The guiding projections extend around the outer circumference of the fixing holes 212, to form cylindrical guides.

A pair of rectangular washer plates 210 are also provided, having fixing holes aligned with the fixing holes in the arms 35*a, b*. In addition, a pair of washers 218 is also provided. The washers 218 are annular, with the central holes sized to receive the guiding projections 214 of the arm 35*b*.

In use, the moveable panel 3 is formed with a pair of slots 220 adjacent the top edge 222. The slots 220 include a circular section (not shown) sized to receive the washer 218, and a narrow neck opening the circular section to the edge 222.

The washers 218 are fitted in the circular sections of the slots 220, and the arms 35 and are mounted either side of the moveable panel 3, with the mounting projections 208 facing away from the panel 3, and the washer plates 210 between the arms 35, and the moveable panel 3. The guiding projections pass through the washers 218, and the washer plates 210, and the arms 35 are secured together by fixing members (not shown) passing through the guide holes 212, 216 and guide projection 214.

In one example, the slots 220 may be elongate to allow the height of the panel 3 to be adjusted, as discussed in relation to the carrier 104 in the second embodiment.

The bearing member 33 includes a base section forming the bearing surface 37. A pair of elongate locating projections 224 extend upwardly from the ends of the base section, which, when the system is assembled, fit into corresponding guide slots 226 formed in the mounting section 208. The bearing member 33 is retained in place by a fixing member 228, which passes through a fixing hole 230 formed in the mounting section 208. The fixing member 33 secures the bearing member by means of an enlarged end 232, which engages with a slot 234 formed by projections 236 extending inwardly from the guide projections 224. The fixing member 228 is threadably engaged in the fixing hole 230—this allows adjustment (in this example 5 mm) for the door in the two carriers (second carrier not shown) in order to allow for a good/perfect seal with the closing panel or wall.

The carrier 31 may be formed of any suitable material, for example metal or alloy or plastics. The bearing members 33*a, b* may be attached to the carrier 31 in any suitable way. For example, mechanical fixings, and/or adhesive may be used. Alternatively, the carrier 104 and bearing members 33*a, b* may be formed of a single unitary piece.

The example interfaces discussed above can be considered low friction interfaces, since they have a coefficient of surface friction less than 0.50μ. This provides for a mechanism having two slidably engaged parts that can easily slide relative to each other, allowing the moveable panel 3 to be opened and closed. It will be appreciated that any suitable low friction materials may be used in this mechanism.

Different types of channel 25 and carrier 31, 104 have been described in relation to particular embodiments. However, it will be appreciated that any of the channel types and/or carriers 31, 104 may be applied to any of the above embodiments, to mount the different shape bearing surfaces 27, 37 of each embodiment.

In the examples discussed above, the bearing surface 27 of the channel 25 has a V-shaped or truncated V-shaped cross section. It will be appreciated that the bearing surface 27 of the channel 25 may have any suitable shape. In one example, the channel may be formed by an open square or rectangular section, with angled sides extending from opposite sides of the open section. In other examples, the channel 25 may be U-shaped, or any other suitable shape. The bearing member 33 may also have any suitable shape.

Furthermore, it will also be appreciated that although the above examples show the carrier 33 with a bearing surface 37 extending for a portion of the length of the carrier 31, the bearing surface 37 may extend for a longer portion of the carrier 33, the whole length of the carrier 33 or longer.

In some, but not all, examples, the header rail 9 may include an arm 41 extending over the moveable panel 3 and the carrier 31, from which a soft stop mechanism 43 is mounted. This is shown in FIG. 1A.

The arms 35*b* of the carrier 31 facing away from the fixed panel 7 interact with the soft stop mechanism 43 to dampen the moveable panel 3 is it reaches either a fully open position or a fully closed position. The soft stop mechanism includes a buffer (not shown) against which the moveable panel presses. The buffer is coupled to a spring that resists the action of the moveable panel 3. The force of the moveable panel 3 is sufficient to compress the spring and keep the door closed, but the movement of the door is slowed.

In embodiments where the carrier is symmetrical, the door may be unhanded and has two different functions: to hold the low friction insert 33 and to have a soft operation mechanism (soft-stop when the door is fully open and self-soft close in the closed position).

In other embodiments, there is no soft stop or soft operation mechanism.

It will be appreciated that the embodiments discussed above are provided by way of example only. In other examples, the movable panel 3 may include a frame (not shown). The carrier 33 may be formed integrally with the frame, or may be connected to the frame 5 and/or panel 7 in any suitable manner.

It will also be appreciated that the number and position of the carriers 33 on the moveable panel 3 may be altered from that in the examples described. In some examples, multiple carriers 33 may be provided at different positions along the top and/or bottom of the moveable panel 3.

The bearing surface 27 of the channel 25 may be provided by a coating of low friction material applied to the frame or by one or more bearing members of low friction material fixed to or formed on the frame 5. In one example, the bearing surface(s) of the frame 5 may comprise one or more separate bearing members (not shown) of different material to the frame. The or each separate bearing member may fit within a slot formed in the frame 5. The or each separate bearing member may be fixed in place by any suitable means, or may simple rest in the slot. The or each separate bearing member may be formed of metal or alloy, for example polished stainless steel or anodized aluminium, or plastics, for example a low friction polymer material. The or each separate bearing member may comprise a single elongate member having a length at least sufficient for the required range of movement of the moveable panel 3. Alternatively the or each separate bearing member may comprise a plurality of shorter members such as pads configured for the required range of movement of the moveable panel 3.

In some examples, the coefficient of friction of the interface between the bearing surfaces may be further reduced by providing a low friction coating, for example by physical vapour deposition (PVD) onto the channel 25 and/or carrier 33.

In the examples discussed above, the channel projection 23 is integral with the header rail 9 forming part of the frame 5 of a shower enclosure. It will be appreciated that in some examples, the channel projection 23 may be a separate component and fixed to the header rail 9 in any suitable manner.

The channel 25 may extend the full length of the header rail 9, or may only be of sufficient length to allow the moveable panel 3 to open fully. Furthermore, it will be appreciated that instead of an elongate channel 25 there may be one or more shorter channels 25. Also, the channel 25 may be on the moveable panel 3 and the carrier 33 on the frame 5 of the shower enclosure, rather than the channel 14 being on the frame 5 and the carrier 21 on the moveable panel 3, as discussed above.

In some examples, the box section 29 of the header rail 9 may be omitted, as shown in FIG. 4, to provide a very low profile system.

It will be appreciated that the above sliding door mechanisms 1, 100, 200 can be applied to any suitable system incorporating a sliding panel. More particularly, any suitable construction of shower enclosure may be used. The construction discussed above is by way of example only, and many different examples of shower enclosure will be apparent to the person skilled in the art.

The invention claimed is:

1. A shower enclosure sliding door mechanism comprising:

a first member provided on a door of a shower enclosure; and a second member provided on a frame of the shower enclosure, the first and second members slidably engaged with each other such that a first bearing surface of the first member slidably engages a second bearing surface of the second member;

wherein the first bearing surface is formed from a first low friction material and includes a pair of surfaces sloped towards a base region and a flat base, the sloped surfaces extending from either end of the flat base such that the first bearing surface is truncated V-shaped in cross section, and the second bearing surface is formed from a second low friction material and arranged to provide a channel within which the first bearing surface sits, such that a low friction interface is formed between the first member and the second member.

2. The mechanism of claim 1, wherein the first bearing surface and second bearing surface contact each other at one or more bearing points.

3. The mechanism of claim 2, wherein one or more gaps between the first bearing surface and second bearing surface are formed adjacent the one or more bearing points.

4. The mechanism of claim 1, wherein the first bearing surface contacts the second bearing surface at least at the bottom of the first bearing surface.

5. The mechanism of claim 1, wherein the second bearing surface comprises a pair of surfaces sloped towards a base point or region.

6. The mechanism of claim 5, wherein the second bearing surface is arranged to locate the first bearing surface with respect to the second bearing surface.

7. The mechanism of claim 5, wherein the pair of surfaces slope toward the base point or region of the second bearing surface and meet at an apex, such that the second bearing surface is substantially V-shaped.

8. The mechanism of claim 5, wherein a first angle between the pair of surfaces of the first bearing surface is less than a second angle between the pair of surfaces of the second bearing surface.

9. The mechanism of claim 1, wherein the second bearing surface includes a base section that is flat or rectangular, wherein the sloped surfaces extend from opposite sides of the base section.

10. The mechanism of claim 1, wherein the first bearing surface is provided on a bearing member mounted on a carrier arranged to be secured to the door, wherein the carrier includes means for mounting the bearing member on a first side of the door.

11. The mechanism of claim 10, wherein the carrier is configured for adjusting the position of the door relative to the frame.

12. The mechanism of claim 10, wherein the bearing member includes the first low friction material on at least the portion of the bearing member that forms the low friction interface.

13. The mechanism of claim 1, wherein the first bearing surface and second bearing surface are substantially symmetrical, about a first axis.

14. The mechanism of claim 1, wherein the second member is an elongate channel constructed and arranged to receive at least a portion of the first bearing surface, the second bearing surface extending along the length of the channel, and the first bearing surface extending along a portion of the length of the channel, wherein the carrier is slidable along the channel to open and close an opening in the frame.

15. The mechanism of claim 1, wherein the second low friction material is provided on at least the portion of the channel that forms the low friction interface.

16. The mechanism of claim 1, wherein at least a portion of the first bearing surface is parallel to the second bearing surface.

17. The mechanism of claim 1, wherein the low friction interface has a coefficient of surface friction of less than 0.50μ.

18. The mechanism of claim 1, wherein the first low friction material is a polymer.

19. The mechanism of claim 1, further comprising a plurality of first members slidably engaged with the second member.

20. A shower enclosure, comprising:

a frame defining an opening;

a door; and a sliding door mechanism, the sliding door mechanism comprising:

a first member provided on the door, the first member having a first bearing surface; and a second member provided on the frame, the second member having a second bearing surface;

wherein the first and second members are slidably engaged with each other such that the first bearing surface slidably engages the second bearing surface;

wherein the first bearing surface is formed from a first low friction material and includes a pair of surfaces sloped towards a base region and a flat base, the pair of surfaces extending from either end of the flat base such that the first bearing surface is a truncated V-shape in cross section, and the second bearing surface is formed from a second low friction material and is arranged to provide a channel within which the first bearing surface sits, such that a low friction interface is formed between the first member and the second member;

wherein the sliding door mechanism mounts the door to the frame for sliding movement of the door relative to the frame to open and close the opening.

* * * * *